US007641353B2

(12) United States Patent
Kostal et al.

(10) Patent No.: US 7,641,353 B2
(45) Date of Patent: Jan. 5, 2010

(54) LIGHT ATTACHMENT

(76) Inventors: Bretislav Kostal, Zelivecka 12, 10600 Prague 10 (CZ); Vladimir Kupa, Frant. Sramka 15, 15000 Prague 5 (CZ)

( * ) Notice: Subject to any disclaimer, the term of this patent is extended or adjusted under 35 U.S.C. 154(b) by 86 days.

(21) Appl. No.: 11/821,886

(22) Filed: Jun. 26, 2007

(65) Prior Publication Data

US 2008/0198580 A1 Aug. 21, 2008

(30) Foreign Application Priority Data

Feb. 16, 2007 (CZ) ..... PV 2007-127

(51) Int. Cl.
*A45B 3/02* (2006.01)
*A63B 15/02* (2006.01)

(52) U.S. Cl. ..... 362/102; 362/109; 362/399

(58) Field of Classification Search ..... 362/102, 362/109, 382, 399, 400, 157, 196, 208, 200; 222/1, 78, 79, 113, 192, 465.1, 467; 116/2, 116/77

See application file for complete search history.

(56) References Cited

U.S. PATENT DOCUMENTS 1,532,493 A * 4/1925 Ivie ..... 340/321
4,319,309 A * 3/1982 Benoit ..... 362/108
4,425,600 A * 1/1984 Barnhart ..... 362/84
5,041,951 A * 8/1991 Fan ..... 362/102
5,086,377 A 2/1992 Roberts
5,193,896 A * 3/1993 Oberlander ..... 362/103
5,359,501 A * 10/1994 Stevens ..... 362/108
5,373,427 A 12/1994 McLean
5,449,104 A * 9/1995 Parsons et al. ..... 224/245
5,476,192 A * 12/1995 Julinot ..... 222/78
5,549,220 A 8/1996 Whalen
5,556,003 A * 9/1996 Johnson et al. ..... 222/39
5,593,074 A * 1/1997 Matthews ..... 224/251
5,673,819 A * 10/1997 Brunswig ..... 222/113
6,439,432 B1 * 8/2002 Park ..... 222/113
6,499,855 B1 * 12/2002 Kukuk ..... 362/102
6,676,270 B2 1/2004 Kostal et al.
6,722,771 B1 * 4/2004 Stephens ..... 362/184
6,752,514 B2 * 6/2004 Parker ..... 362/183
6,959,469 B2 * 11/2005 Blauer et al. ..... 16/431
7,121,432 B2 10/2006 Kostal et al.
7,150,540 B2 * 12/2006 Kovacik et al. ..... 362/245
7,287,538 B2 * 10/2007 Lin et al. ..... 135/16

* cited by examiner

*Primary Examiner*—Jacob Y Choi
(74) *Attorney, Agent, or Firm*—Collard & Roe, P.C.

(57) ABSTRACT

A light attachment for fastening to a carrier structure including a light source (4), a battery (5) and a light source controlling switch (23) comprising a casing (1) with a front side and a rear side and including a head portion (16) with a first opening (17) for the light source (4) in the front side and an elongated body portion with a second opening for a switch actuating arm in the front side and further comprising a removable elastic sleeve (6) for surrounding at least partially the elongated body and the carrier structure to urge and fasten the rear side of the casing (1) to the carrier structure.

14 Claims, 4 Drawing Sheets

LIGHT ATTACHMENT

FIELD OF THE INVENTION

This invention relates to a light attachment for fastening to a carrier structure comprising a light source, battery and a light source-controlling switch and means for attaching it to a carrier structure in combination with which the light attachment may be used. The carrier structure may be a self-defense device such as a defense-spray containers, batons, clubs, or other carriers serving various purposes such as walking sticks, ski sticks etc. In combination with a self-defense device, the flashlight of the light attachment should help the intended victim or a law enforcement personnel to allocate the assailant's face and/or to partially blind and deter him or subsequently to apply the defending spray or a baton if the assailant continues in his action

DESCRIPTION OF THE PRIOR ART

There are many types of combined devices known in the art. Most of them are based on a conventional concept of a torch or battery lamp that is adapted for mounting on a self-defense spray container or a baton. As disclosed in U.S. Pat. No. 5,086,377, this defense device may consist of a middle portion comprising a defending spray and an end portion with a light and sound alarm device. This device is big in size, and therefore is not suitable to be carried in a handbag or pocket.

From the U.S. Pat. No. 5,549,220, a pistol-shape device is known that includes a housing, a storage battery, two lamps emitting blue and white light, respectively, a sound source, and a chemical repellant container. The device includes at least three separate compartments, internal wiring and piping to provide the respective connections between the operating switches, battery, lamps, and a gas nozzle. The device is operated by two switches and a trigger, and may be rather confusing in a situation when it should be used very quickly and with an immediate and surprising effect against unexpected assailants. Moreover, due to its considerable size, this device is not suitable to be carried in a handbag, specifically, a woman's shoulder bag or clutch bag, or in a pocket.

U.S. Pat. No. 5,373,427 discloses a device having a shape of a conventional elongated torch housing serving as a holder with a lamp emitting light substantially at a right angle to the torch holder and disposed at the upper end thereof. A self-defense spray container is inserted in the housing below the lamp and the lower interior part of the housing is occupied by a battery pack. The access to the spray-activating button on the container is covered by a rotational cover, which when lifted in its upper position operates as a switch connecting the terminals of the lamp and batteries to activate the emission of light. In the lower closed position, the cover surface leans towards the vertically biased exterior portion of the housing and closes the opening providing access to the spray-actuating button. When the defender uses the device, the cover must be first located, then gripped by a finger, and lifted. The time necessary for taking such actions may be critical, particularly, when a victim is exposed to a sudden or unexpected assailant's attack. Moreover, the design, where the lamp is separated from the batteries by a spray container, requires rather complicated connection between the lamp, the batteries, and the switch, and has relatively big dimensions, like with the above-described devices.

U.S. Pat. No. 6,676,270 discloses a device combining a self-defense spray container and a light source, whereby a LED diode is used as a light source and a button-type battery is used as an accumulator. This solution allows the size of the device, as a whole, to be reduced considerably and enables various mutual configurations of its individual elements. According to one of the embodiments, both the light source and the spray may be actuated by a single pressing button. Nevertheless, the adaptation to various types of spray containers is rather complicated.

Another variance of the combined device shown by U.S. Pat. No. 7,121,432 prevents spontaneous manipulation, while enabling an easy and quick control of the light source and the spray. Like in the previous case, the dimensions of the light source attachment always correspond to a certain type of spray container, and it cannot be used for another type of a container or even another type of a self-defense device.

It is therefore the primary object of the invention to provide a light attachment of a universal shape that could be used in combination with various types and sizes of self-defense devices including spray defense containers and batons, and in combination with other equipment and accessories.

Another object of the invention is to provide a specific structure of the light attachment adapted to receive miniaturized components and thus enables the size of the light attachment to be minimized so that it can be used in conjunction with a specific fastening means.

Still another object of the invention is to provide a light attachment, which may be easily attached to and released from a carrier structure by specific means, which, in addition, provide a comfortable and safe handgrip and hold of a combined self-defense device.

SUMMARY OF THE INVENTION

A light attachment for fastening to a carrier structure including a light source, a battery, and a light source controlling switch according to the invention comprises a casing with a front side and a rear side, a head portion with a first opening for the light source in the front side, and an elongated body portion with a second opening for a switch actuating arm in the front side and further comprising a removable elastic sleeve for surrounding the front side of the elongated body portion and an opposite, remote surface of the carrier structure to urge and to fasten the rear side of the casing to the carrier structure.

To minimize the size of the light attachment and to render it adaptable for various carrier structures, the casing of the light attachment has a substantially wedge-shaped structure tapered on the front side and widened on the rear side. Further, the casing includes two lateral beams joined together by the top head portion at one end and by a bottom at the other end. The switch-actuating arm is located between the beams and mounted for rocking motion on the front edges of the beams through lateral pivots and the front edges of the beams are provided with recesses for receiving said lateral pivots.

Further, in connection with said aspects of the invention, it is preferred that the beams are connected by a baffle partitioning the internal space of the casing between the head and the bottom into a switch compartment and a battery compartment.

To enable a safe and easy grip, the outer surface of the elastic sleeve has a selectively embossed structure. More specifically, the outer surface of the elastic sleeve has a specific knurling in the area covering the switch-actuating arm and is separated by a boss from the other embossed structure of the front side.

Alternatively, where the light attachment is used in combination with larger structures or where the elastic sleeve passes through a hole in the carrier structure, the elastic sleeve may be in a form of a belt provided with connecting means on its ends.

In preferred embodiments, the light attachment is combined with such carrier structures as a self-defense spray container or a baton.

BRIEF DESCRIPTION OF THE DRAWINGS

Further objects of the present invention together with additional features contributing thereto will be apparent from preferred embodiments of the invention as illustrated in the accompanying drawings with certain figures on a larger scale wherein.

DETAILED DESCRIPTION OF THE PREFERRED EMBODIMENT

Figure 3:
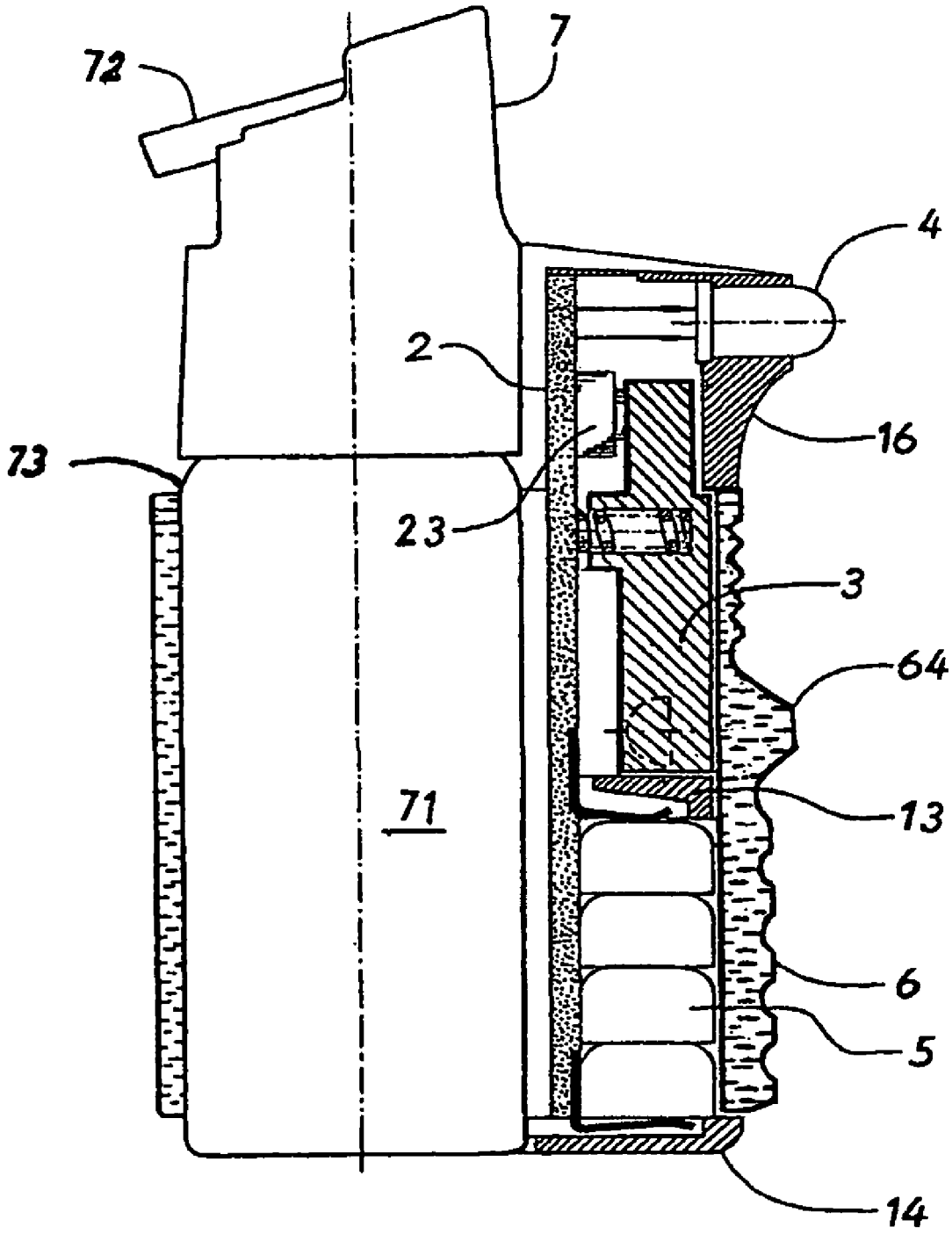
FIG. 3 is a sectional side view of the light attachment shown in FIG. 2.
Figure 4:
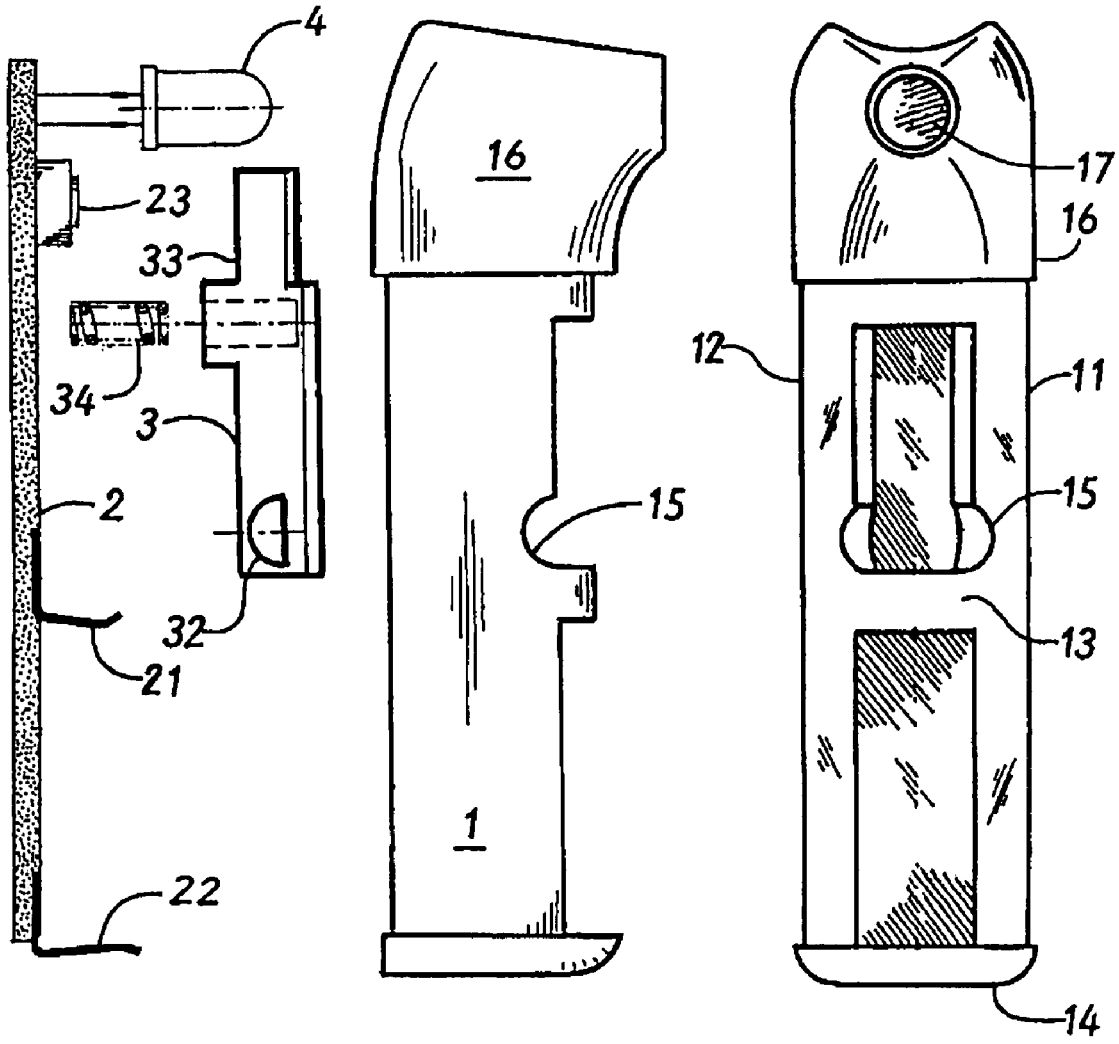
FIG. 4 is an exploded view showing a side and a front view of the casing structure and parts incorporated therein.

The light attachment according to the invention shown in detail in FIG. 3 and in exploded view in FIG. 4 includes a casing 1, consisting of two elongated lateral beams 11, 12 joined together by a common head 16 at their top ends and by a bottom 14 at their lower ends. The beams 11, 12 form together with the head 16 and the bottom 14 a wedge shaped structure with a tapered front side and a widened rear side. The widened rear side is designed to engage a body of a carrier structure to which the light attachment shall be fastened. Further, the beams 11, 12 are connected on the front side by a transverse baffle 13 partitioning the interior space of the casing 1 between the head 16 and the bottom 14 into a switch compartment and a battery compartment. On the front side, the head 16 has an opening 17 occupied by the light beam emitting part of the light source 4 in this embodiment, the light source is a light emitting diode (LED). The switch compartment above the baffle 13 is occupied by a switch actuating arm 3 provided with a contact end 33 and lateral pivots 32 through which the actuating arm 3 is mounted for rocking motion on the circular recesses 15 made in the front side edges of the beams 11, 12. The battery compartment is occupied by a battery source 5; in the present embodiment, the battery source is represented by a button-type batteries pack.

The rear side of the casing 1 is closed by a cover board 2 which carries the light source 4, a switch 23 and battery contacts 21, 22. The cover board 2 includes the respective wiring or printed circuits for providing the connection of the battery source 5 to the light source 4 over the switch 23. The switch 23 is actuated by the contact end 33 of the manually operated switch-actuating arm 3. The contact end 33 of the switch-actuating arm 3 is held in the disengaged position with respect to the switch 23 by a pressure spring 34. The outer surface of the cover board is slightly curved inwards so that it engages a carrier structure preferably by its marginal longitudinal edges to secure its stabile position of the light source with respect to the carrier structure body.

Figure 1:
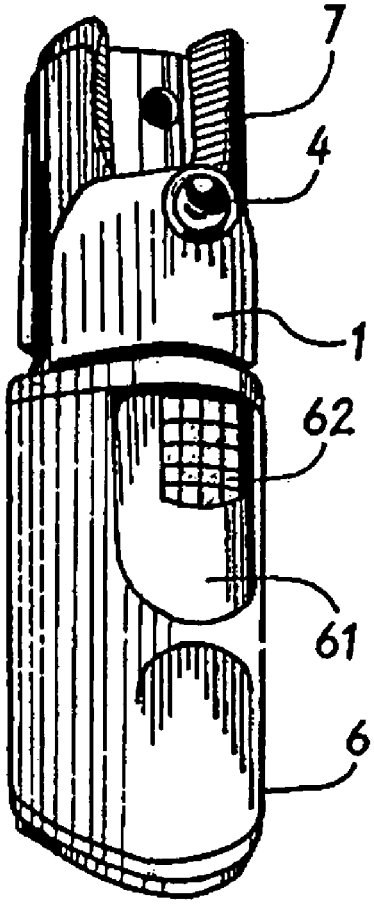
FIG. 1 is a perspective front view of a light attachment fastened to a self-defense spray container.
Figure 2:
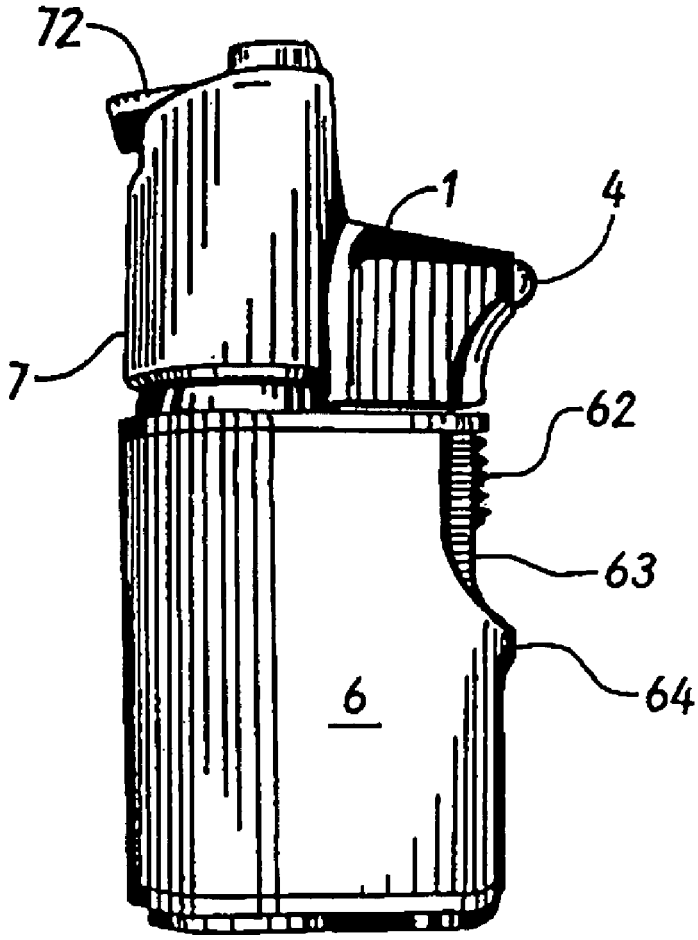
FIG. 2 is a perspective side view of light attachment fastened to a self-defense spray container.
Figure 5:
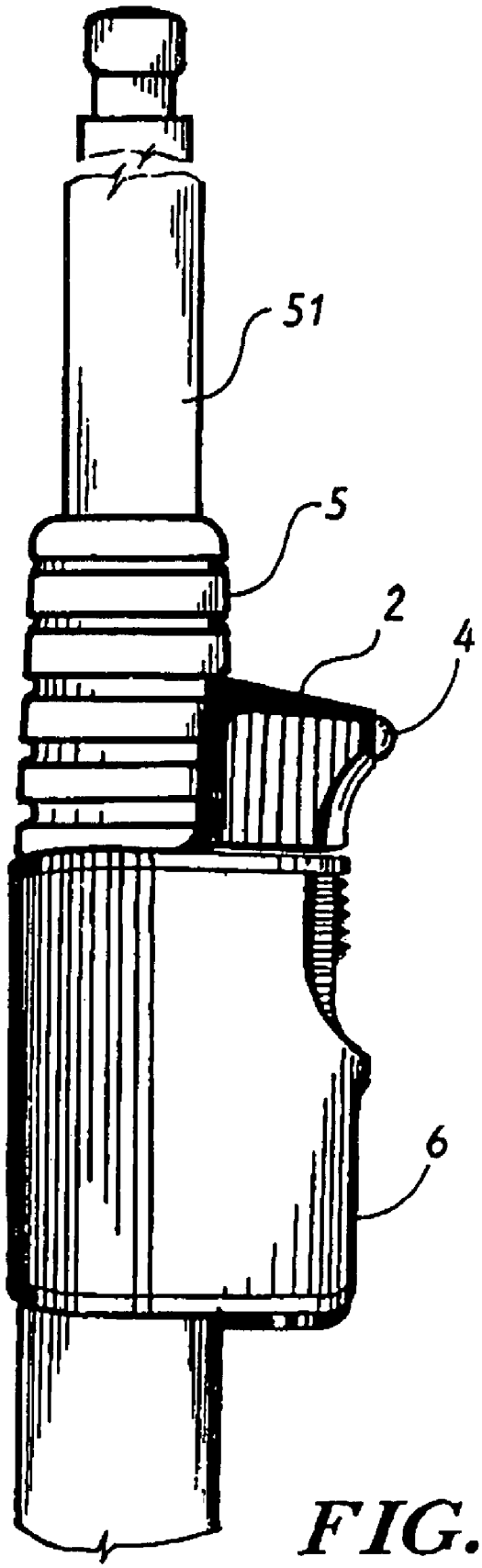
FIG. 5 is a perspective side view of the light attachment fastened to a police baton.

Another part of the light attachment is an elastic sleeve 6, illustrated in section in FIG. 3, having an outer shape as shown in FIGS. 1, 2, and 5. The elastic sleeve 6 is designed for fastening the light attachment to various carrier structures, which, by way of example, are represented by a spray-defense apparatus 7 shown in FIGS. 1 and 2 and a police baton 5 shown in FIG. 5. It is to be noted that in FIGS. 1, 2, and 5, the light attachment and the carriers are shown in real scale to enable one to get the picture of the real minimal size of the light attachment. The spray-defense apparatus 7 in FIGS. 1, 2, and 3 includes a conventional spray container 71 of a cylindrical shape, a cap comprising an internal valve, a gas outlet nozzle, and a valve-actuating button 72. The casing 1 leans by its widened rear side towards the wall of the spray container 71. The elastic sleeve 6 surrounds the front part of the casing 1 and the opposite circular surface 73 of the spray container 71, and the effect of tension forces accumulated in the elastic sleeve 6 from its previous forced stretching of putting it on the spray container 71 urges the casing 1 towards the adjacent circular surface of the spray container 71. The exerted pressure ensures a safe fastening of the casing 1 to the spray container 71 in a predetermined mutual position. Nevertheless, the preferred position is where the axis of the spray outlet nozzle and the axis of the LED light beam are parallel and share the same vertical plain. In the embodiment of FIG. 5, the light attachment is fastened by the elastic sleeve 6 to a cylindrical handle of a police baton 5 including a telescopic shaft 51 shown in its extended configuration.

To enable an easy grip and control, the elastic sleeve 6 is on its outer side provided with a selectively embossed structure 63 and at the area contacting the switch actuating arm 3 with a specific knurling 62 in a recess 61 separated by a boss 64 from the other embossed structure on the front side. The boss 64 projects slightly over the front side plane and the recess 61 so that it avoids spontaneous engaging the switch actuating 3 arm when, in circumstances, the carrier structure is urged against a rigid surface on the side of the light attachment.

In use, the valve-actuating button 72 is controlled by thumb, while the switch actuating arm 3 is controlled by forefinger or another finger at the area of the specific knurling 62 of the elastic sleeve 6 covering the switch-actuating arm 3. An inoperable empty spray container 71 may easily be replaced by taking down the elastic sleeve 6 and pulling it on the existing light attachment and a new spray container 71. The elastic sleeve 6 may be produced as a ring, an endless belt, or an elastic strip made, for example, from a suitable rubber composition, wherein the elastic strip may be provided with connecting means at its ends, such as "Velcro"-type fasteners, etc. The latter embodiment may be practical in combination with larger carrier structures or where the elastic sleeve 6 passes through a hole in the carrier structure.

INDUSTRIAL APPLICABILITY

As indicated above, the light attachment is not only designed for its use in combination with a spray-defense apparatus or a baton, as described above, but it may also be used in combination with a club, walking stick, ski stick, or any other object including a portion to which, with respect to its shape and size, the light attachment may be fastened by an elastic sleeve.

The invention claimed is:

1. A light attachment for fastening to a carrier structure including a light source, a battery compartment and a light source controlling switch comprising:

a casing with a front side and a rear side for engaging the carrier structure, wherein the casing comprises a head portion with a first opening for the light source in the front side and an elongated body portion with a second opening in the front side;

a controlling switch actuating arm in the front side of the elongated body portion located in said second opening; and a removable elastic sleeve for surrounding the front side of the elongated body portion including said second opening with the controlling switch actuating arm and an opposite, remote surface of the carrier structure to fasten the casing to the carrier structure.

2. The light attachment according to claim 1, wherein the casing has a wedge-shaped structure tapered on the front side and widened on the rear side.

3. The light attachment according to claim 1, wherein the casing includes two lateral beams joined together by the head portion at one end and by a bottom at the other end.

4. The light attachment according to claim 3, wherein the controlling switch actuating arm is located between the beams and mounted for rocking motion on the front edges of the beams through lateral pivots and the front edges of the beams are provided with recesses for receiving said lateral pivots.

5. The light attachment according to claim 3, wherein the beams are connected by a baffle dividing the internal space of the casing between the head portion and the bottom into a switch compartment and the battery compartment.

6. The light attachment according to claim 1, wherein the outer surface of the elastic sleeve has a selectively embossed structure.

7. The light attachment according to claim 6, wherein the outer surface of the elastic sleeve has a specific knurling in the area covering the switch actuating arm separated by a boss from the other embossed structure of the front side.

8. The light attachment according to claim 1, wherein the elastic sleeve is a belt comprising first and second ends and a connector provided at said ends.

9. The light attachment according to claim 1, wherein the carrier structure is a spray-defense apparatus.

10. The light attachment according to claim 1, wherein the carrier structure is a baton.

11. A light attachment for fastening to a carrier structure including a light source, a battery compartment and a light source controlling switch comprising:

a casing of a wedge-shaped structure tapered on the front side and widened on the rear side comprising two lateral beams forming an elongated body portion joined together by a head portion at one end and by a bottom at the other end;

a first opening for the light source in the front side of the head portion;

a second opening in the front side of the elongated body;

a controlling switch actuating arm located in said second opening and mounted for rocking motion on said lateral beams; and a removable elastic sleeve for surrounding the front side of the elongated body portion including said second opening with the controlling switch actuating arm and an opposite, remote surface of the carrier structure to fasten the casing to the carrier structure.

12. A light attachment for fastening to a spray defense apparatus including a light source, a battery compartment and a light source controlling switch comprising:

a casing with a front side and a rear side for engaging the spray defense apparatus, the casing comprising a head portion with a first opening for the light source in the front side and an elongated body portion with a second opening in the front side;

a controlling switch actuating arm in the front side of the elongated body portion located in said second opening;

a removable elastic sleeve for surrounding the front side of the elongated body portion including said controlling switch actuating arm located in said second opening and an opposite, remote surface of the spray defense apparatus to fasten the casing to the spray defense apparatus.

13. The light attachment according to claim 12, wherein the outer surface of the elastic sleeve has a selectively embossed structure.

14. The light attachment according to claim 13, wherein the outer surface of the elastic sleeve has a specific knurling in the area covering the switch actuating arm separated by a boss from the other embossed structure of the front side.

* * * * *